US007437790B1

(12) United States Patent
Ajello

(10) Patent No.: US 7,437,790 B1
(45) Date of Patent: Oct. 21, 2008

(54) POOL CLEANING VACUUM EMPLOYING MULTIPLE POWER SUPPLY SOURCES AND ASSOCIATED METHOD

(76) Inventor: Mike Ajello, 3480 W. Warner Ave., Ste G., Santa Ana, CA (US) 92704

( * ) Notice: Subject to any disclaimer, the term of this patent is extended or adjusted under 35 U.S.C. 154(b) by 0 days.

(21) Appl. No.: 11/705,707

(22) Filed: Feb. 12, 2007

Related U.S. Application Data

(60) Provisional application No. 60/772,132, filed on Feb. 13, 2006.

(51) Int. Cl.
*E04H 4/16* (2006.01)

(52) U.S. Cl. ..... 15/1.7; 15/344; 15/350; 15/351; 29/596; 29/597

(58) Field of Classification Search ..... 15/1.7, 15/344, 350, 351; 29/596, 597, 598
See application file for complete search history.

(56) References Cited

U.S. PATENT DOCUMENTS 4,776,053 A * 10/1988 Kiraly ..... 15/1.7
4,962,559 A 10/1990 Schuman
5,317,776 A * 6/1994 DeMoura ..... 15/1.7
5,507,058 A * 4/1996 Minami et al. ..... 15/1.7
D485,652 S 1/2004 Erlich
6,842,931 B2 * 1/2005 Porat et al. ..... 15/1.7

* cited by examiner

*Primary Examiner*—Joseph J. Hail, III
*Assistant Examiner*—Anthony Ojini

(57) ABSTRACT

A pool cleaning vacuum employing multiple power supply sources and associated method includes a body including first, second and third vertically juxtaposed chambers formed therein. The chambers share a wall with the second chamber wherein the third chamber is isolated therefrom. A motor assembly and a filter section are housed within the first chamber. The filter section is located downstream of the motor assembly, and has an open lateral face exposed to the aqueous environment. An anchor shaft is seated within the second chamber and extends through an entire longitudinal length of the body. A vacuum head is pivotally attached to the anchor shaft. The vacuum head includes a conduit in communication with the filter section, and a plurality of wheels rotatably coupled to opposed corners thereof. A mechanism transmits a predetermined quantity of power to the motor assembly.

15 Claims, 8 Drawing Sheets

POOL CLEANING VACUUM EMPLOYING MULTIPLE POWER SUPPLY SOURCES AND ASSOCIATED METHOD

CROSS REFERENCE TO RELATED APPLICATIONS

This application claims the benefit of U.S. Provisional Application No. 60/772,132, filed Feb. 13, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pool vacuums and, more particularly, to a pool cleaning vacuum employing multiple power supply sources for supplying continuous power during intermittent applications.

2. Prior Art

Swimming pools accumulate debris over a period of time. Some of the debris is cleaned from the pool water as the water is recycled and filtered. Other debris sinks to the bottom of the pool and is not cleaned during water recycling and filtration. To clean the debris that sinks to the bottom of the pool, a swimming pool vacuum cleaner may be employed. One form of swimming pool vacuum cleaner makes use of the swimming pool filter assembly. That is, normal connections of the swimming pool filter assembly are altered, and a long vacuum hose is attached to the filter. The vacuum hose is then used for vacuuming the pool. However, the vacuum produced by the filter assembly may be insufficient unless the filter is backwashed. This requires additional time and effort. After the pool is vacuumed, the vacuum hose is disconnected, and the filter is returned to normal. These alterations to the filter system are time consuming and inconvenient. Moreover, the repetitive disassembly and reassembly of filter connections imposes unwanted wear and tear on the filter components.

One prior art example shows a new and improved swimming pool vacuum apparatus that includes an extensible handle assembly which serves as a handle grasped by an operator and which supports a vacuum motor assembly. The vacuum motor assembly is used for providing vacuum power to a vacuum head assembly which contacts the bottom and the walls of a swimming pool. The vacuum head assembly is also supported by the extensible handle assembly. An electrical conductor assembly, connected between the vacuum motor assembly and a source of AC power, is used for conducting electrical power from the source of AC power to the vacuum motor assembly. The electrical conductor assembly includes a ground fault circuit interrupter assembly for interrupting electrical power flow from the source of AC power to the vacuum motor assembly in the event of a short circuit. The extensible handle assembly may include a plurality of handle units connected together in telescopic fashion and also includes an electrically insulating hand grip member. Unfortunately, this prior art example requires the availability of an AC power source nearby. In addition, this example requires the use of electrical cords which may present a tripping hazard to a user during operating conditions.

Another prior art example shows a swimming pool vacuum cleaner that has a water powered turbine and a rotary brush directly and rigidly connected to the turbine so that rotation of the turbine imparts corresponding rotation to the rotary brush. A stationary brush partially surrounds the rotary brush and a foraminate screen is positioned upstream from the brushes to trap residue loosened by the brushes. Unfortunately, this prior art example does not include a multitude of power supply means including a rechargeable battery pack, a DC battery cell, and an electrical cord suitable for plugging into an existing AC power supply.

Accordingly, a need remains for a pool cleaning vacuum employing multiple power supply sources and associated method in order to overcome the above-noted shortcomings. The present invention satisfies such a need by providing an apparatus that is convenient and easy to use, is lightweight yet durable in design, and provides a means for cleaning an aqueous environment. Such a vacuum eliminates bulky pool vacuum hoses that can get tangled, making it easier to maneuver around a pool while cleaning it, as well as making the vacuum lighter. The vacuum simplifies pool cleaning which makes the job easier and less time consuming, and removes the necessity of hiring a professional cleaning service. The vacuum will leave any pool sparkling clean and free of debris and algae. The present invention is simple to use, inexpensive, and designed for many years of repeated use.

BRIEF SUMMARY OF THE INVENTION

In view of the foregoing background, it is therefore an object of the present invention to provide an apparatus for a pool cleaning vacuum employing multiple power supply sources and associated method. These and other objects, features, and advantages of the invention are provided by a portable vacuum cleaner for cleaning an aqueous environment.

The apparatus includes a body including first, second and third vertically juxtaposed chambers effectively formed therein. Such a body includes a plurality of gills formed within an outer wall thereof and conveniently situated adjacent to the motor assembly (herein described below) such that filtered water advantageously exits the body via the gills after the unfiltered water passes through the filter section (herein described below). Each of such first and third chambers share a wall with the second chamber wherein the third chamber is advantageously isolated from the first and second chambers such that water is effectively prohibited from entering the third chamber when the body is submerged into the aqueous environment.

The apparatus further includes a motor assembly and a filter section housed within the first chamber. Such a filter section is advantageously located downstream of the motor assembly, and has an open lateral face effectively exposed to the aqueous environment such that the user can quickly remove the filter section during maintenance procedures. A rigid and rectilinear anchor shaft is seated within the second chamber and effectively extends through an entire longitudinal length of the body. Such an anchor shaft is removably mated to an existing swimming pool cleaning pole.

The apparatus further includes a vacuum head disposed exterior of the body and pivotally attached directly to the anchor shaft. Such a vacuum head includes a flexible conduit in fluid communication with the filter section such that unfiltered water is effectively directed upwardly through the conduit and into the filter section. The vacuum head further includes a plurality of wheels rotatably coupled to opposed corners thereof.

The apparatus further includes a mechanism for automatically and continuously transmitting a predetermined quantity of power to the motor assembly such that a user can continuously operate the vacuum cleaner while conveniently receiving power from alternate sources. Such an automatic power transmitting mechanism includes first, second and third power supply sources. Such a second power supply source includes a portable battery pack seated externally of the body and electrically mated with the motor assembly, while the third power supply source includes a rechargeable battery pack removably seated within the third chamber and electrically mated with the motor assembly. Such a first power supply source provides a 110 volt alternating current, while the second and third power supply sources supply a 12 volt direct current.

First, second and third power inlet ports are respectively and directly mated to the first, second and third power supply sources. First, second and third switches are respectively and directly coupled to the first, second and third inlet ports. A transformer is electrically and directly coupled to the first switch for advantageously stepping down the 110 volt alternating current to a 12 direct current prior to reaching the motor assembly.

The apparatus further includes a voltage detecting and distribution circuit electrically mated to the first, second and third switches for detecting and continuously distributing the 12 volt direct current from at least one of the first, second and third power supply sources to the motor assembly during operating conditions such that the user can continuously operate the vacuum cleaner when any two of the first, second and third power supply sources are inactive. The first switch is normally maintained at a closed position such that the 12 volt direct current from the transformer is a primary power supply source. The second and third switches are normally maintained at open positions respectively such that the 12 volt direct current from the second and third power supply sources are backup power supply sources.

The voltage detecting and distribution circuit includes a processor, and a memory electrically coupled to the processor and including software instructions that effectively cause the voltage detecting and distribution circuit to automatically toggle the first, second and third switches between on and off positions such that only one of the first, second and third power supply sources direct a corresponding one of the 12 volt direct currents to the motor assembly. Such software instructions include and execute a control logic algorithm including the steps of periodically inquiring about a voltage level remaining within the first, second and third power sources respectively, detecting whether the voltage level of the first power supply source has fallen below a predetermined minimum voltage level threshold, and if yes, toggling the first switch to an open position, determining which one of the second and third power supply sources has a lower voltage level that is above the predetermined minimum voltage level threshold, toggling one of the second and third switches to a closed position that is associated with the power supply source that has the lower voltage level above the predetermined minimum voltage level threshold, and if no, maintaining the first switch at a closed position and further maintaining the second and third switches at the open position, and repeating steps a-f.

The filter section includes a canister, and a cylindrical filter member conveniently housed within the canister. A one-way check valve automatically pivots between open and closed positions when the motor assembly is toggled to on and off positions. Such a filter member has axially opposed ends directly coupled to the one-way check valve and the motor assembly respectively for effectively directing the unfiltered water through the filter and out from the body via the gills.

A method for cleaning a bottom surface of an aqueous environment includes the steps of providing a body including first, second and third vertically juxtaposed chambers formed therein. Each of such first and third chambers share a wall with the second chamber wherein the third chamber is isolated from the first and second chambers such that water is prohibited from entering the third chamber when the body is submerged into the aqueous environment. The steps further include providing a motor assembly housed within the first chamber, providing a filter section housed within the first chamber and located downstream of the motor assembly, positioning a rigid and rectilinear anchor shaft within the second chamber and through an entire longitudinal length of the body, pivotally attaching a vacuum head directly to the anchor shaft, and automatically and continuously transmitting a predetermined quantity of power to the motor assembly such that a user can continuously operate the vacuum cleaner while receiving power from alternate sources.

The first chamber has an open lateral face exposed to the aqueous environment such that the user can quickly remove the filter section during maintenance procedures. The anchor shaft is removably mated to an existing swimming pool cleaning pole, and the vacuum head is disposed exterior of the body. The vacuum head includes a flexible conduit in fluid communication with the filter section such that unfiltered water is directed upwardly through the conduit and into the filter section. The vacuum head further includes a plurality of wheels rotatably coupled to opposed corners thereof, and the body includes a plurality of gills formed within an outer wall thereof and situated adjacent to the motor assembly such that filtered water exits the body via the gills after the unfiltered water passes through the filter section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
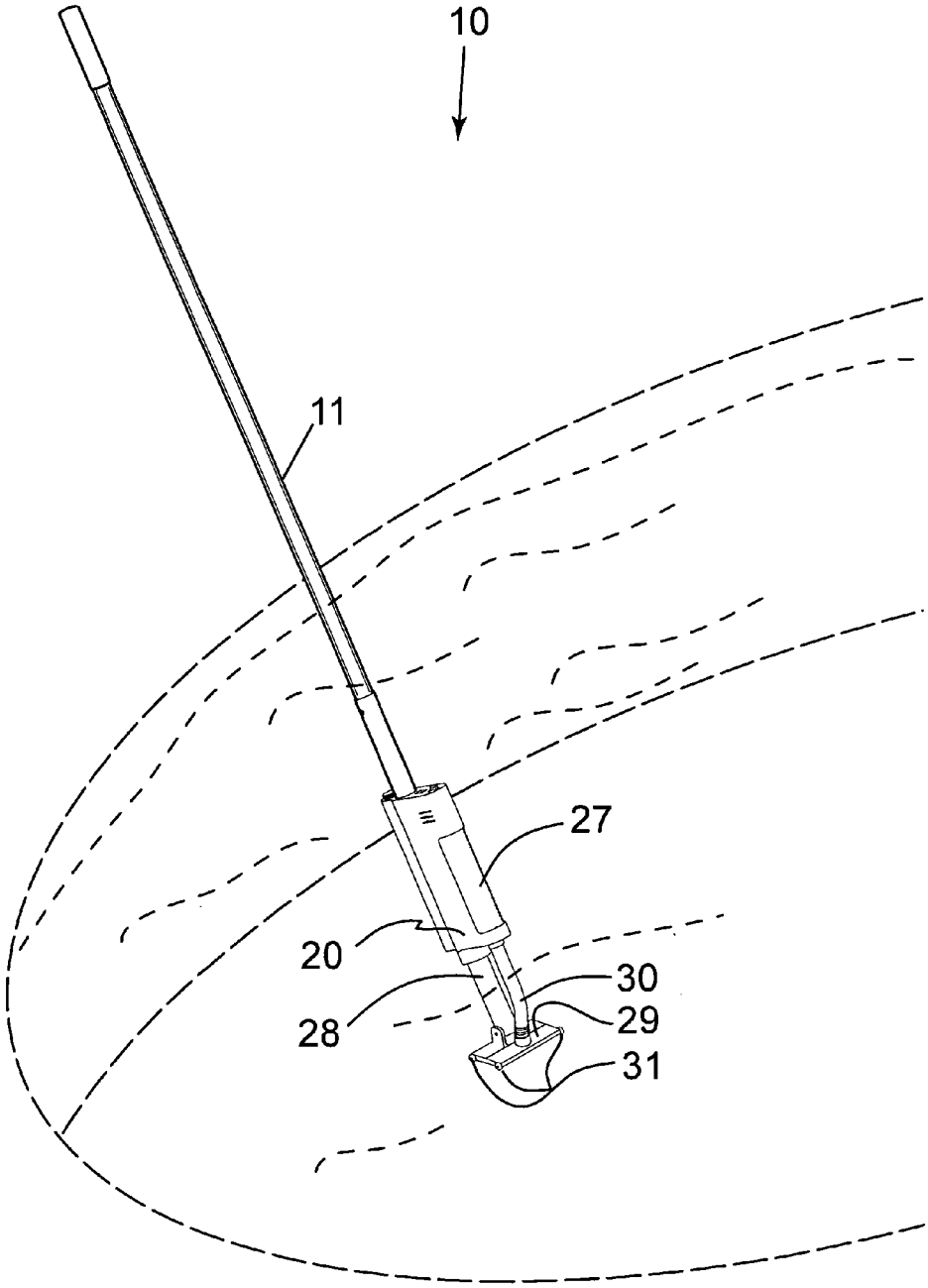
FIG. 1 is a perspective view of a pool cleaning vacuum employing multiple power supply sources, shown in an aqueous environment, in accordance with the present invention.
Figure 2:
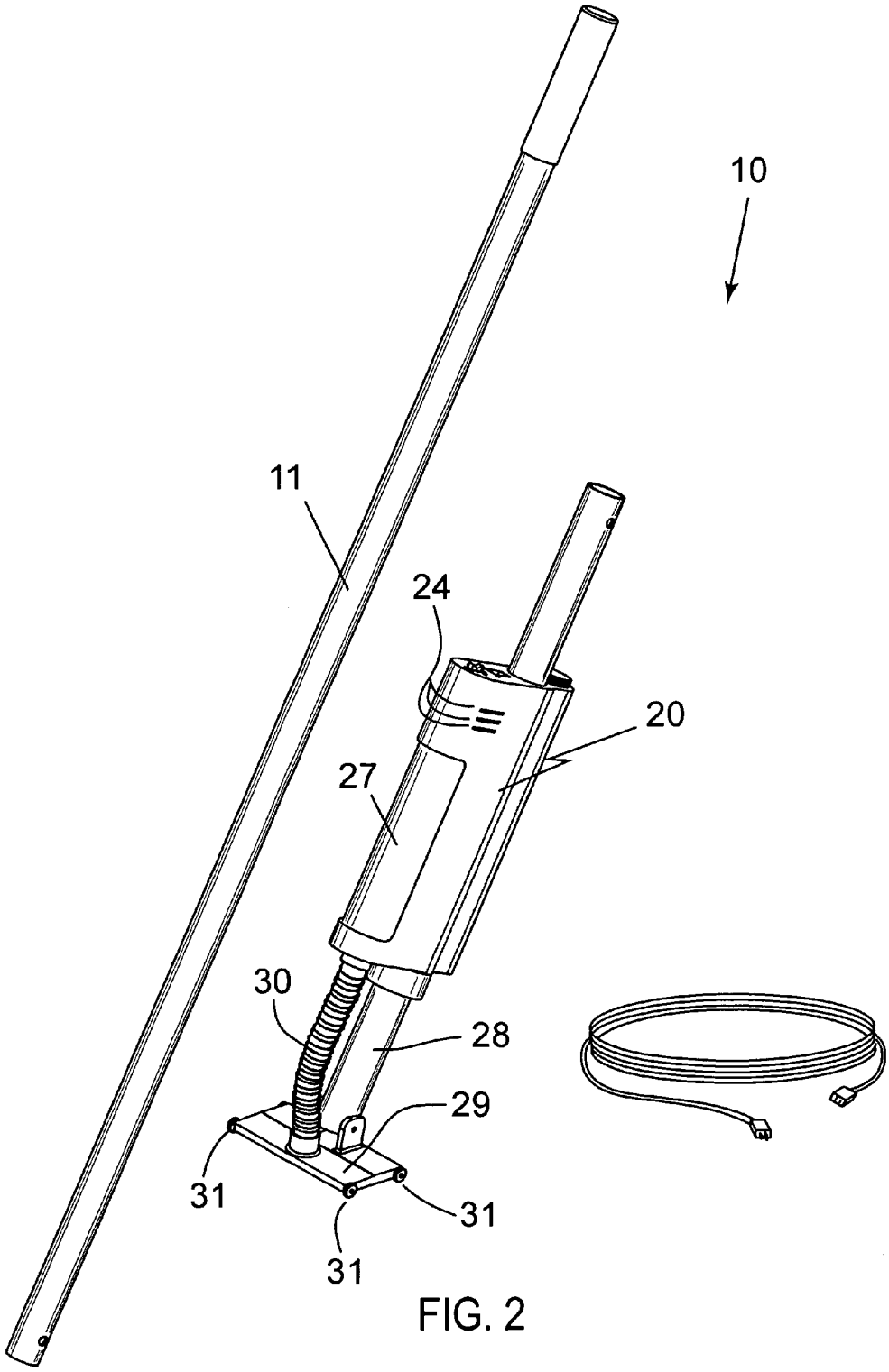
FIG. 2 is a perspective view of the apparatus shown in FIG. 1, showing an existing pool cleaning pole, the apparatus, and a power cord respectively.
Figure 3:
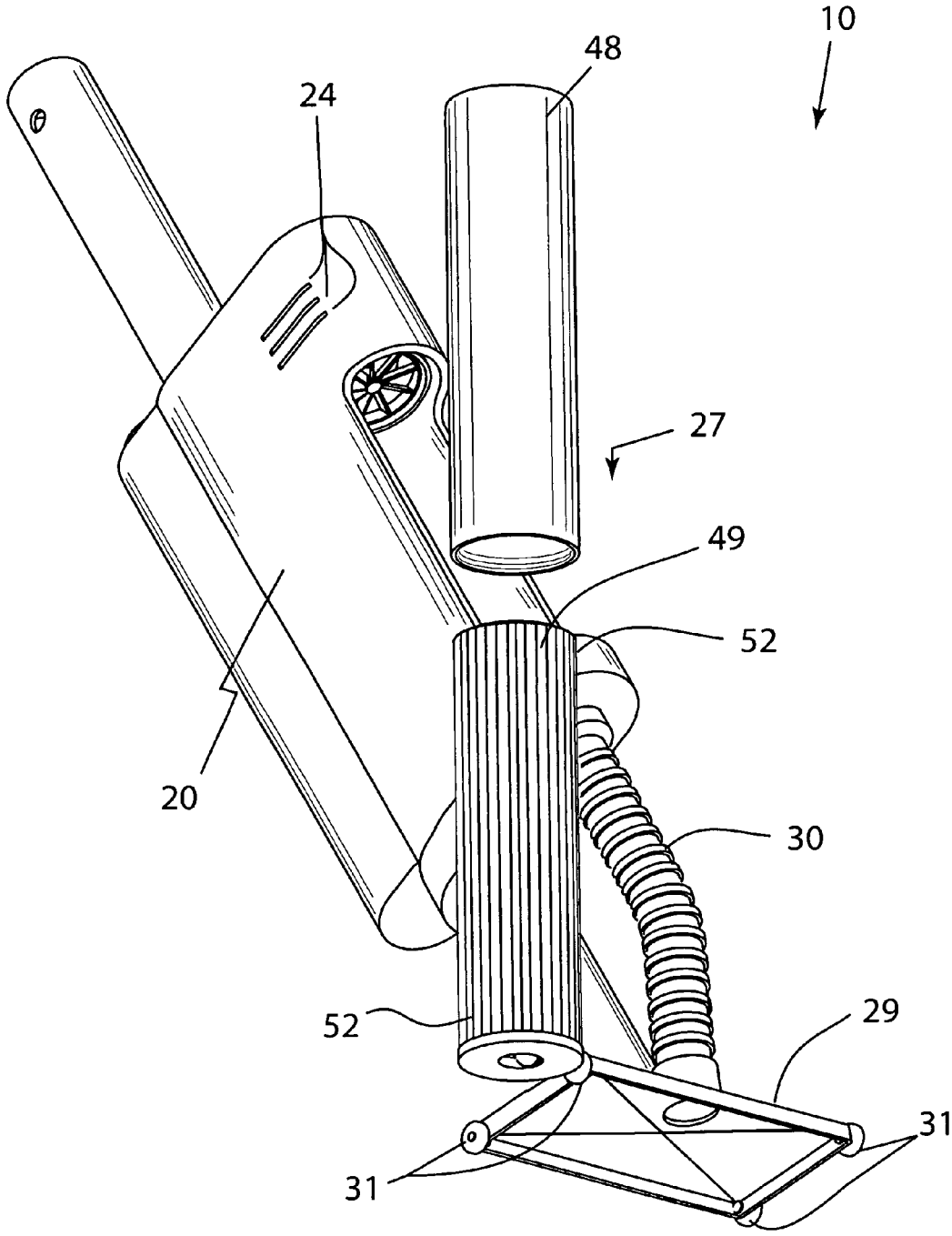
FIG. 3 is a perspective of the filter section, shown removed from the body.
Figures 4, 5:
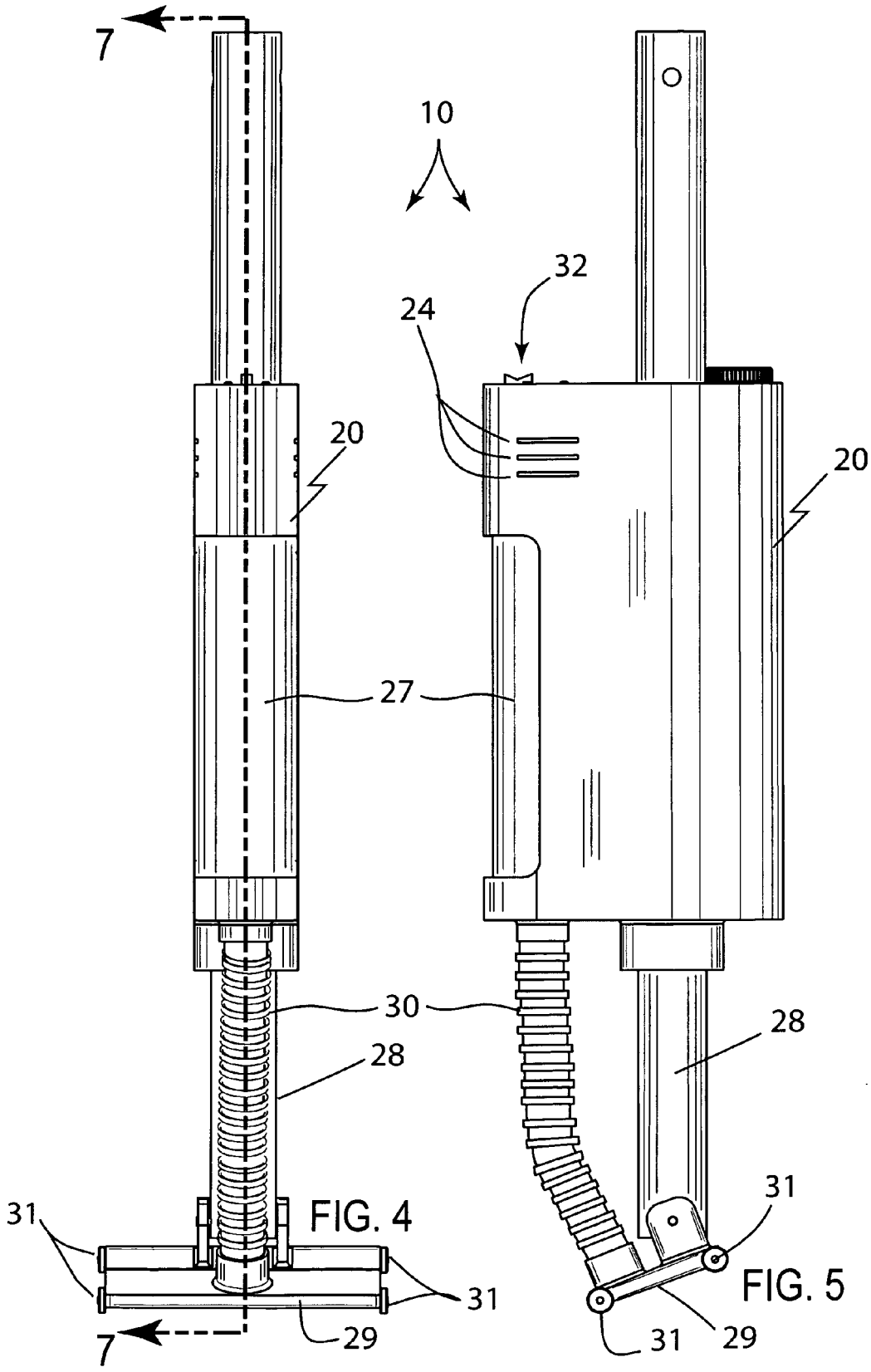
FIG. 4 is a top plan view of the apparatus.
FIG. 5 is a side elevational view of the apparatus.
Figure 6:
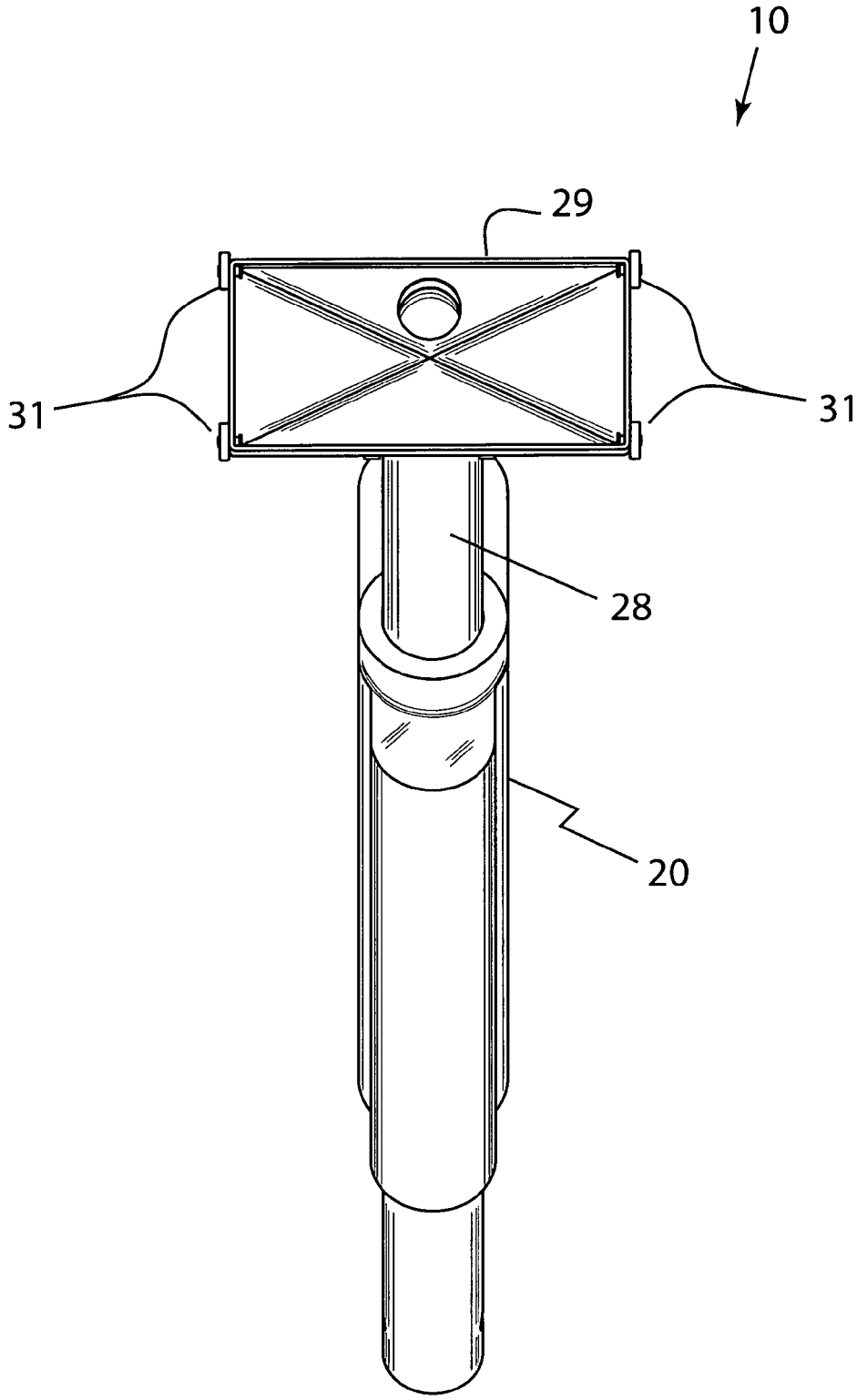
FIG. 6 is a bottom plan view of the apparatus.
Figure 7:
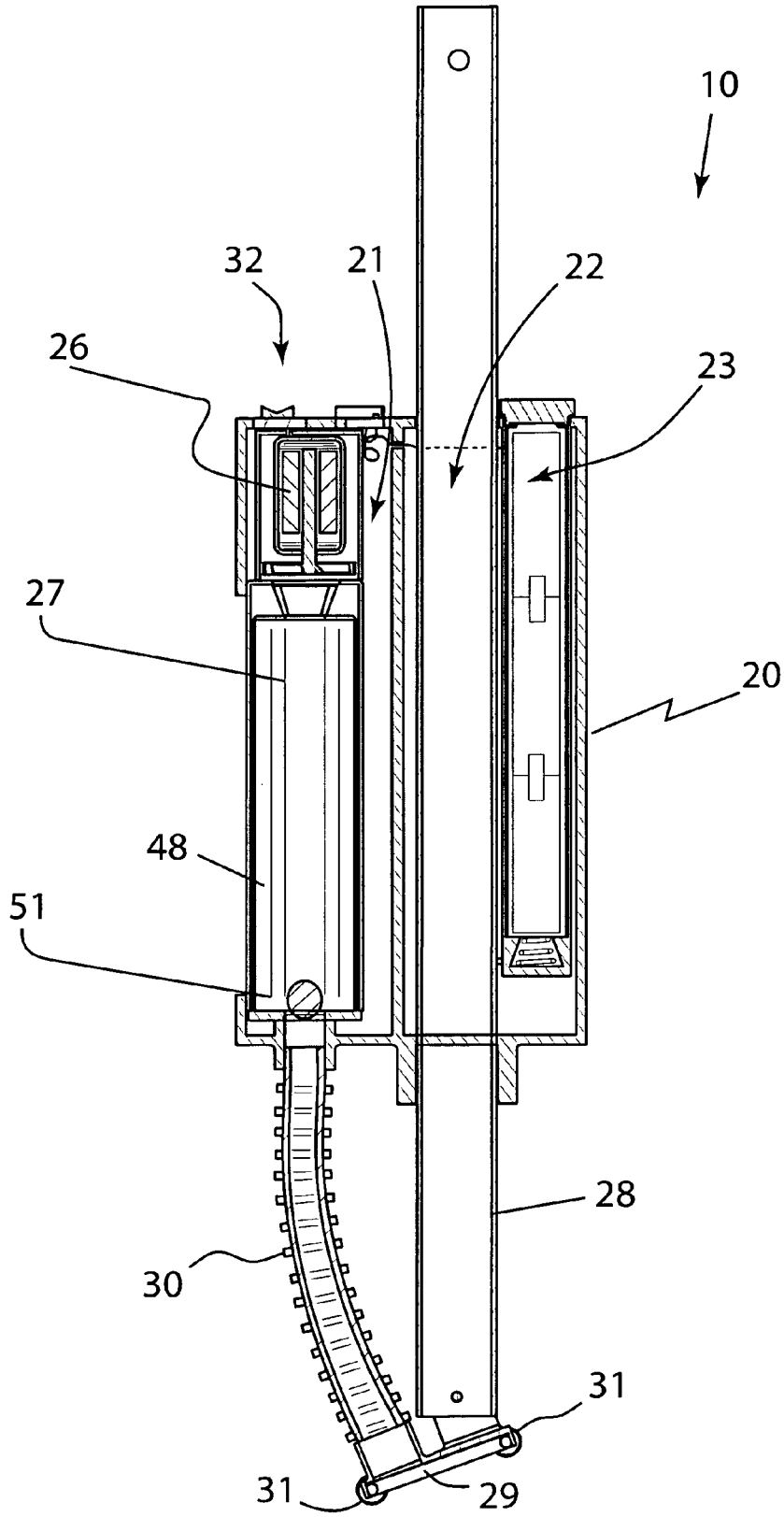
FIG. 7 is a cross sectional view of the apparatus shown in FIG. 4, taken along line 7-7.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-9 by the reference numeral 10 and is intended to provide a pool cleaning vacuum employing multiple power supply sources and associated method. It should be understood that the apparatus 10 may be used to clean many different types of aqueous environments and should not be limited in use to cleaning only those types of aqueous environments described herein.

Referring to FIGS. 1, 2, 3, 4, 5, 6, 7 and 8, the apparatus 10 includes a body 20 including first 21, second 22 and third 23 vertically juxtaposed chambers formed therein. Such a body 20 includes a plurality of gills 24 formed within an outer wall thereof and situated adjacent to the motor assembly 26 (herein described below), which is essential such that filtered water advantageously exits the body 20 via the gills 24 after the unfiltered water passes through the filter section 27 (herein described below). The gills 24 allow filtered water to be reintroduced into the aqueous environment after passing through the filter section 27. Each of such first and third chambers 21, 23 share a wall with the second chamber 22 wherein the third chamber 23 is advantageously isolated from the first and second chambers 21, 22, which is critical such that water is prohibited from entering the third chamber 23 when the body 20 is submerged into the aqueous environment. Prohibiting water from entering the third chamber 23 is crucial for preventing a short circuit of the apparatus 10 due to water undesirably contacting a power source.

Referring to FIGS. 1, 2, 3, 5, 7 and 9, the apparatus 10 further includes a motor assembly 26 and a filter section 27 housed within the first chamber 21. Such a filter section 27 is advantageously located downstream of the motor assembly 26, and has an open lateral face exposed to the aqueous environment, which is crucial such that the user can quickly remove the filter section 27 during maintenance procedures. Such downstream positioning of the filter section 27 ensures that water is efficiently drawn therethrough by the motor assembly 26 during operating procedures. A rigid and rectilinear anchor shaft 28 is seated within the second chamber 22 and extends through an entire longitudinal length of the body 20, and is removably mated to an existing swimming pool cleaning pole 11. By extending through an entire longitudinal length of the body 20, such an anchor shaft 28 provides sufficient rigidity that the body 20 can be properly manipulated by a user when the body 20 is attached to an existing swimming pool cleaning pole 11.

Referring to FIGS. 1, 2, 3, 4, 5, 6 and 7, the apparatus 10 further includes a vacuum head 29 disposed exterior of the body 20 and pivotally attached directly to the anchor shaft 28, without the use of intervening elements. Such a vacuum head 29 includes a flexible conduit 30 in fluid communication with the filter section 27, which is vital such that unfiltered water is directed upwardly through the conduit 30 and into the filter section 27. The vacuum head 29 further includes a plurality of wheels 31 rotatably coupled to opposed corners thereof. The wheels 31 and vacuum head 29 allow a user to comfortably and easily move the apparatus 10 through an aqueous environment during operating conditions.

Figure 9:
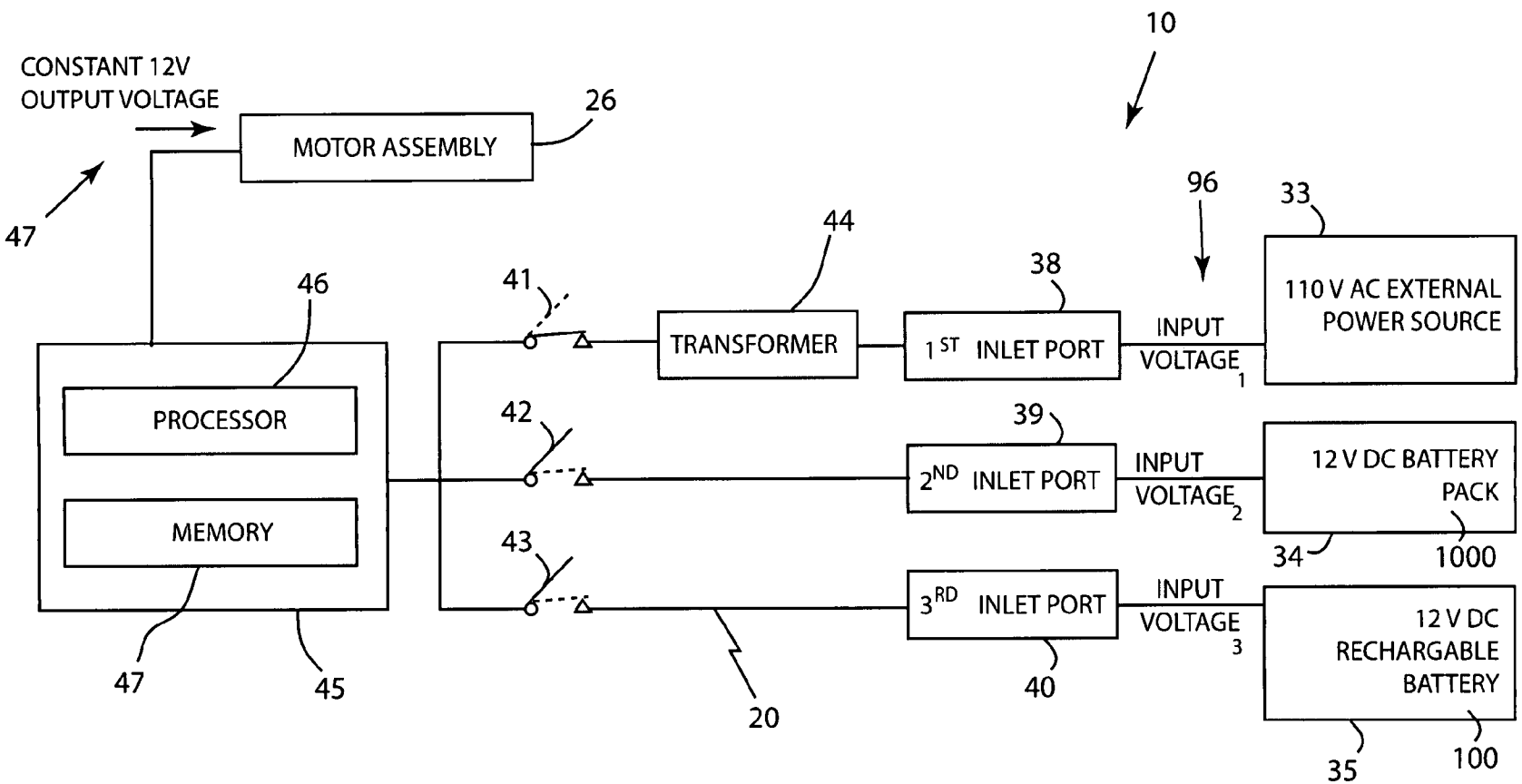
FIG. 9 is a schematic block diagram of the apparatus.

Referring to FIG. 9, the apparatus 10 further includes a mechanism 32 for automatically and continuously transmitting a predetermined quantity of power to the motor assembly 26, which is necessary such that a user can continuously operate the apparatus 10 while receiving power from alternate sources. Such an automatic power transmitting mechanism 32 includes first 33, second 34 and third 35 power supply sources, which is crucial for allowing a user to selectively choose a power source 33, 34, 35 based on user desire. For example, a user may choose the rechargeable power supply source 33 (herein described below) in environments where an alternating current power source 33 (herein described below) is not available.

Such a second power supply source 34 includes a portable battery pack 100 seated externally of the body 20 and electrically mated with the motor assembly 26, while the third power supply source 35 includes a rechargeable battery pack 100 removably seated within the third chamber 23 and electrically mated with the motor assembly 26. Such a first power supply source 33 provides a 110 volt alternating current, while the second and third power supply sources 34, 35 supply a 12 volt direct current.

Figure 8:
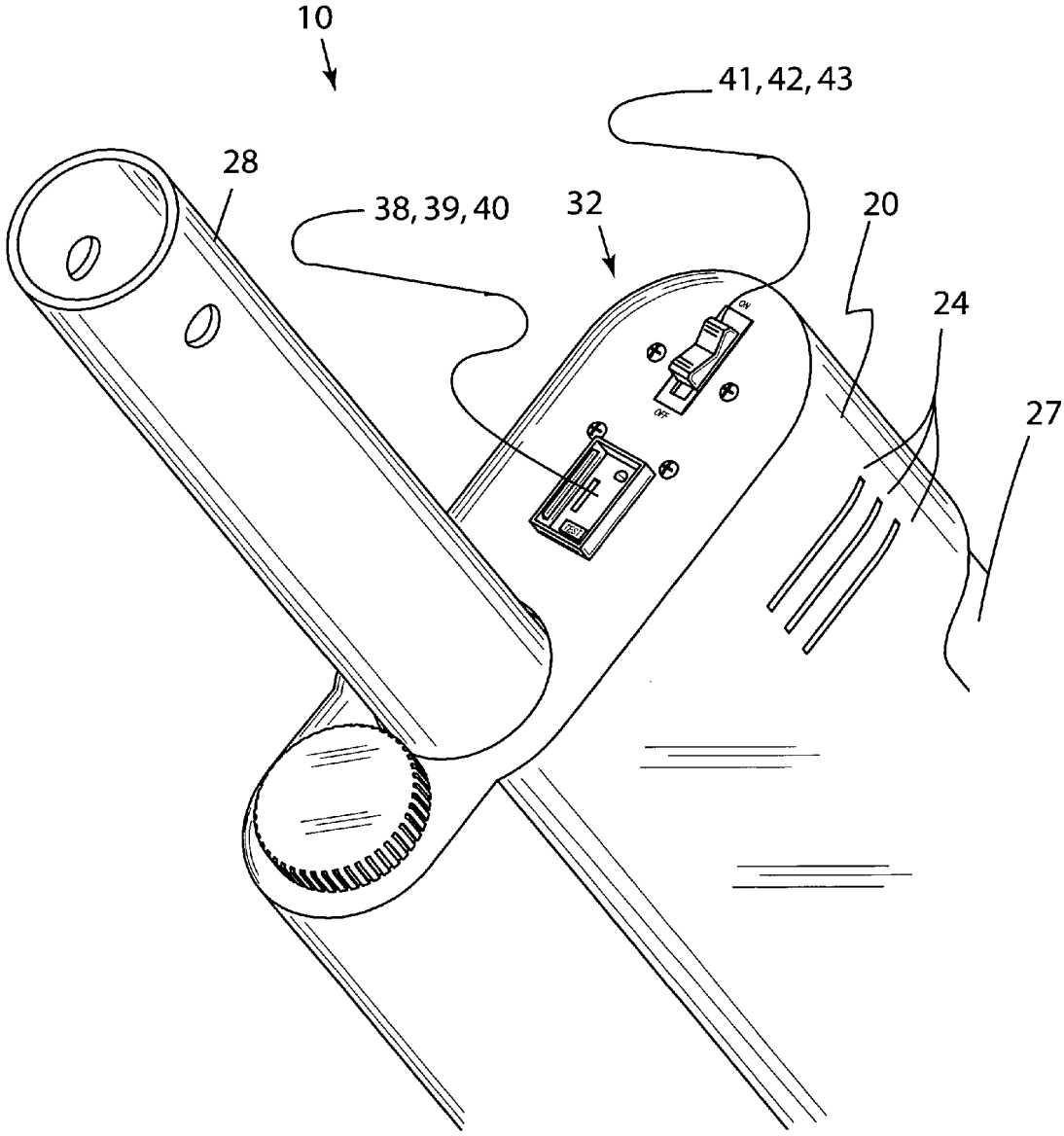
FIG. 8 is a rear perspective view of the apparatus.

Referring to FIGS. 8 and 9, first 38, second 39 and third 40 power inlet ports are respectively and directly mated to the first, second and third power supply sources 33, 34, 35, without the use of intervening elements, and first 41, second 42 and third 43 switches are respectively and directly coupled to the first, second and third inlet ports 38, 39, 40, without the use of intervening elements. Such inlet ports 38, 39, 40 and switches 41, 42, 43 allow a user to manually choose between power sources 33, 34, 35 as desired. A transformer 44 is electrically and directly coupled to the first switch 41, without the use of intervening elements, which is important for advantageously stepping down the 110 volt alternating current to a 12 direct current prior to reaching the motor assembly 26. Such a transformer 44 is necessary to step down the alternating current to a direct current that is proper for powering the apparatus 10 during operating conditions.

Referring to FIG. 9 the apparatus 10 further includes a voltage detecting and distribution circuit 45 electrically mated to the first, second and third switches 41, 42, 43 for detecting and continuously distributing the 12 volt direct current from at least one of the first, second and third power supply sources 33, 34, 35 to the motor assembly 26 during operating conditions, which is essential such that the user can continuously operate the apparatus 10 when any two of the first, second and third power supply sources 33, 34, 35 are inactive. The first switch 41 is normally maintained at a closed position, which is critical such that the 12 volt direct current from the transformer 44 is a primary power supply source. The second and third switches 42, 43 are normally maintained at open positions respectively, which is crucial such that the 12 volt direct current from the second and third power supply sources 34, 35 are backup power supply sources.

Referring to FIG. 9, the voltage detecting and distribution circuit 45 includes a processor 46, and a memory 47 electrically coupled to the processor 46 and including software instructions that cause the voltage detecting and distribution circuit 45 to automatically toggle the first, second and third switches 41, 42, 43 between on and off positions, which is crucial such that only one of the first, second and third power supply sources 33, 34, 35 direct a corresponding one of the 12 volt direct currents to the motor assembly 26. Such software instructions include and execute a control logic algorithm including the steps of periodically inquiring about a voltage level remaining within the first, second and third power sources 33, 34, 35 respectively, detecting whether the voltage level of the first power supply source 33 has fallen below a predetermined minimum voltage level threshold, and if yes, toggling the first switch 41 to an open position, determining which one of the second and third power supply sources 34, 35 has a lower voltage level that is above the predetermined minimum voltage level threshold, toggling one of the second and third switches 42, 43 to a closed position that is associated with the power supply source that has the lower voltage level above the predetermined minimum voltage level threshold, and if no, maintaining the first switch 41 at a closed position and further maintaining the second and third switches 42, 43 at the open position.

Referring to FIG. 9, the present invention 10 is designed to operate off of one of three power supply sources transmitting either a desired 12 volt DC or a 110 volt AC, so that a desired 12 volt DC output load can be automatically maintained a constant voltage level. The voltage detecting and distribution circuit 45 acts as a regulator for providing the constant 12 volt DC output voltage and continuously holds the output voltage at the desired value regardless of changes in load current or input voltage generated by the first, second and third 33, 34, 35 power supply sources.

Circuit 45 monitors the output voltage 97, and adjusts the current sources 33, 34, 35 (as required by the load) to hold the output voltage at the desired 12 volt DC value. The input voltage value 96 of the first power source 33 defines the maximum load current the circuit 45 can source and still maintain regulation. The output voltage 97 is controlled using a feedback loop (not shown), which compensates the current flow to assure loop stability.

In a preferred embodiment, circuit 45 may employ a linear regulator that has a built-in compensation, and is completely stable without external components. By employing a linear regulator, the present invention may quickly equalize the output voltage because linear regulators require only a finite amount of time to "correct" the output voltage after a change in load current demand. This "time lag" defines the characteristic called transient response, which is a measure of how fast the regulator returns to steady-state conditions after a load change.

Circuit 45 operates by comparing the actual output voltage to an internal fixed reference voltage. Any difference is amplified and used to control the regulation element. This forms a negative feedback servo control loop. If the output voltage is too low, the regulation element is commanded to produce a higher voltage. If the output voltage is too high, the regulation element is commanded to produce a lower voltage. In this way, the output voltage is held roughly constant. Advantageously, circuit 45 is able to produce the desired tradeoff between stability and speed of response.

An alternate embodiment may employ a different regulator (like Low-Dropout types), which does require some external capacitance connected from the output lead to ground to assure regulator stability.

Referring to FIGS. 1, 2, 3, 5 and 7, the filter section 27 includes a canister 48, and a cylindrical filter member 49 housed within the canister 48. The filter member 49 is removable from the canister 48, which is vital such that a user can easily replace a clogged filter member 49 with a new one. A one-way check valve 51 automatically pivots between open and closed positions when the motor assembly 26 is toggled to on and off positions, thereby eliminating the necessity of a user to manually toggle the one-way check valve 51 during operating procedures. Such a filter member 49 has axially opposed ends 52 directly coupled to the one-way check valve 51 and the motor assembly 26 respectively, without the use of intervening elements, which is vital for directing the unfiltered water through the filter member 49 and out from the body 20 via the gills 24. The one-way check valve 51 thereby prevents unfiltered water from prematurely and undesirably exiting the body 20 through the vacuum head 29 and connected conduit 30.

The ability of a user to choose from a plurality of power sources 33, 34, 35 provides the unexpected benefit of allowing a user to operate the apparatus 10 in surroundings where only one power source is available, thereby providing a user with flexibility and convenience. In addition, such a plurality of power sources 33, 34, 35 allows a user to operate the apparatus 10 without the use of a power cord, which reduces the tripping hazard associated with other vacuums, and thereby overcomes the previously mentioned prior art shortcomings.

In operation, a method for cleaning a bottom surface of an aqueous environment includes the steps of providing a body 20 including first 21, second 22 and third 23 vertically juxtaposed chambers formed therein. Each of such first and third chambers 21, 23 share a wall with the second chamber 22 wherein the third chamber 23 is isolated from the first and second chambers 21, 22 such that water is prohibited from entering the third chamber 23 when the body 20 is submerged into the aqueous environment. The steps further include providing a motor assembly 26 housed within the first chamber 21, providing a filter section 27 housed within the first chamber 21 and located downstream of the motor assembly 26, positioning a rigid and rectilinear anchor shaft 28 within the second chamber 22 and through an entire longitudinal length of the body 20, pivotally attaching a vacuum head 29 directly to the anchor shaft 28, without the use of intervening elements, and automatically and continuously transmitting a predetermined quantity of power to the motor assembly 26 such that a user can continuously operate the apparatus 10 while receiving power from alternate sources.

The first chamber 21 has an open lateral face exposed to the aqueous environment such that the user can quickly remove the filter section 27 during maintenance procedures. The anchor shaft 28 is removably mated to an existing swimming pool cleaning pole 11, and the vacuum head 29 is disposed exterior of the body 20. The vacuum head 29 includes a flexible conduit 30 in fluid communication with the filter section 27, which is vital such that unfiltered water is directed upwardly through the conduit 30 and into the filter section 27. The vacuum head 29 further includes a plurality of wheels 31 rotatably coupled to opposed corners thereof, and the body 20 includes a plurality of gills 24 formed within an outer wall thereof and situated adjacent to the motor assembly 26, which is necessary such that filtered water exits the body 20 via the gills 24 after the unfiltered water passes through the filter section 27.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable vacuum cleaner for cleaning an aqueous environment, said vacuum cleaner comprising:

a body including first, second and third vertically juxtaposed chambers formed therein, each of said first and third chambers sharing a wall with said second chamber wherein said third chamber is isolated from said first and second chambers such that water is prohibited from entering said third chamber when said body is submerged into the aqueous environment;

a motor assembly housed within said first chamber;

a filter section housed within said first chamber and being located downstream of said motor assembly;

a rigid and rectilinear anchor shaft seated within said second chamber and extending through an entire longitudinal length of said body, said anchor shaft being removably mated to an existing swimming pool cleaning pole;

a vacuum head disposed exterior of said body and pivotally attached directly to said anchor shaft, said vacuum head including a flexible conduit in fluid communication with said filter section such that unfiltered water is directed upwardly through said conduit and into said filter section, said vacuum head further including a plurality of wheels rotatably coupled to opposed corners thereof; and means for automatically and continuously transmitting a predetermined quantity of power to said motor assembly such that a user can continuously operate said vacuum cleaner while receiving power from alternate sources;

wherein said body includes a plurality of gills formed within an outer wall thereof and situated adjacent to said motor assembly such that filtered water exits said body via said gills after the unfiltered water passes through said filter section;

wherein said automatic power transmitting means comprises first, second and third power supply sources, said first power supply source providing a 110 volt alternating current, said second and third power supply sources supplying a 12 volt direct current;

first, second and third power inlet ports respectively and directly mated to said first, second and third power supply sources;

first, second and third switches respectively and directly coupled to said first, second and third inlet ports;

a transformer electrically and directly coupled to said first switch for stepping down said 110 volt alternating current to a 12 direct current prior to reaching said motor assembly; and a voltage detecting and distribution circuit electrically mated to said first, second and third switches for detecting and continuously distributing said 12 volt direct current from at least one of said first, second and third power supply sources to said motor assembly during operating conditions such that the user can continuously operate said vacuum cleaner when any two of said first, second and third power supply sources are inactive;

wherein said first switch is normally maintained at a closed position such that said 12 volt direct current from said transformer is a primary power supply source;

wherein said second and third switches are normally maintained at open positions respectively such that said 12 volt direct current from said second and third power supply sources are backup power supply sources.

2. The vacuum cleaner of claim 1, wherein said voltage detecting and distribution circuit comprises:

a processor;

a memory electrically coupled to said processor and including software instructions that cause said voltage detecting and distribution circuit to automatically toggle said first, second and third switches between on and off positions such that only one of said first, second and third power supply sources direct a corresponding one of said 12 volt direct currents to said motor assembly, said software instructions including and executing a control logic algorithm including the steps of a. periodically inquiring about a voltage level remaining within said first, second and third power sources respectively, b. detecting whether said voltage level of said first power supply source has fallen below a predetermined minimum voltage level threshold, c. if yes, toggling said first switch to an open position;

d. determining which one of said second and third power supply sources has a lower voltage level that is above said predetermined minimum voltage level threshold;

e. toggling one of said second and third switches to a closed position that is associated with said power supply source having the lower voltage level above said predetermined minimum voltage level threshold, and f. if no, maintaining said first switch at a closed position and further maintaining said second and third switches at said open position.

3. The vacuum cleaner of claim 1, wherein said second power supply source comprises:

a portable battery pack seated externally of said body and electrically mated with said motor assembly.

4. The vacuum cleaner of claim 1, wherein said third power supply source comprises:

a rechargeable battery pack removably seated within said third chamber and electrically mated with said motor assembly.

5. The vacuum cleaner of claim 1, wherein said filter section comprises:

a canister;

a cylindrical filter member housed within said canister; and a one-way check valve automatically pivotal between open and closed positions when said motor assembly is toggled to on and off positions, said filter member having axially opposed ends directly coupled to said one-way check valve and said motor assembly respectively for directing the unfiltered water through said filter and out from said body via said gills.

6. A portable vacuum cleaner for cleaning an aqueous environment, said vacuum cleaner comprising:

a body including first, second and third vertically juxtaposed chambers formed therein, each of said first and third chambers sharing a wall with said second chamber wherein said third chamber is isolated from said first and second chambers such that water is prohibited from entering said third chamber when said body is submerged into the aqueous environment;

a motor assembly housed within said first chamber;

a filter section housed within said first chamber and being located downstream of said motor assembly, said first chamber having an open lateral face exposed to the aqueous environment such that the user can quickly remove said filter section during maintenance procedures;

a rigid and rectilinear anchor shaft seated within said second chamber and extending through an entire longitudinal length of said body, said anchor shaft being removably mated to an existing swimming pool cleaning pole;

a vacuum head disposed exterior of said body and pivotally attached directly to said anchor shaft, said vacuum head including a flexible conduit in fluid communication with said filter section such that unfiltered water is directed upwardly through said conduit and into said filter section, said vacuum head further including a plurality of wheels rotatably coupled to opposed corners thereof; and means for automatically and continuously transmitting a predetermined quantity of power to said motor assembly such that a user can continuously operate said vacuum cleaner while receiving power from alternate sources;

wherein said body includes a plurality of gills formed within an outer wall thereof and situated adjacent to said motor assembly such that filtered water exits said body via said gills after the unfiltered water passes through said filter section;

wherein said automatic power transmitting means comprises first, second and third power supply sources, said first power supply source providing a 110 volt alternating current, said second and third power supply sources supplying a 12 volt direct current;

first, second and third power inlet ports respectively and directly mated to said first, second and third power supply sources;

first, second and third switches respectively and directly coupled to said first, second and third inlet ports;

a transformer electrically and directly coupled to said first switch for stepping down said 110 volt alternating current to a 12 direct current prior to reaching said motor assembly; and a voltage detecting and distribution circuit electrically mated to said first, second and third switches for detecting and continuously distributing said 12 volt direct current from at least one of said first, second and third power supply sources to said motor assembly during operating conditions such that the user can continuously operate said vacuum cleaner when any two of said first, second and third power supply sources are inactive;

wherein said first switch is normally maintained at a closed position such that said 12 volt direct current from said transformer is a primary power supply source;

wherein said second and third switches are normally maintained at open positions respectively such that said 12 volt direct current from said second and third power supply sources are backup power supply sources.

7. The vacuum cleaner of claim 6, wherein said voltage detecting and distribution circuit comprises:

a processor;

a memory electrically coupled to said processor and including software instructions that cause said voltage detecting and distribution circuit to automatically toggle said first, second and third switches between on and off positions such that only one of said first, second and third power supply sources direct a corresponding one of said 12 volt direct currents to said motor assembly, said software instructions including and executing a control logic algorithm including the steps of a. periodically inquiring about a voltage level remaining within said first, second and third power sources respectively, b. detecting whether said voltage level of said first power supply source has fallen below a predetermined minimum voltage level threshold, c. if yes, toggling said first switch to an open position;

d. determining which one of said second and third power supply sources has a lower voltage level that is above said predetermined minimum voltage level threshold;

e. toggling one of said second and third switches to a closed position that is associated with said power supply source having the lower voltage level above said predetermined minimum voltage level threshold, and f. if no, maintaining said first switch at a closed position and further maintaining said second and third switches at said open position.

8. The vacuum cleaner of claim 6, wherein said second power supply source comprises:

a portable battery pack seated externally of said body and electrically mated with said motor assembly.

9. The vacuum cleaner of claim 6, wherein said third power supply source comprises:

a rechargeable battery pack removably seated within said third chamber and electrically mated with said motor assembly.

10. The vacuum cleaner of claim 6, wherein said filter section comprises:

a canister;

a cylindrical filter member housed within said canister; and a one-way check valve automatically pivotal between open and closed positions when said motor assembly is toggled to on and off positions, said filter member having axially opposed ends directly coupled to said one-way check valve and said motor assembly respectively for directing the unfiltered water through said filter and out from said body via said gills.

11. A method for cleaning a bottom surface of an aqueous environment comprising the steps of:

a. providing a body including first, second and third vertically juxtaposed chambers formed therein, each of said first and third chambers sharing a wall with said second chamber wherein said third chamber is isolated from said first and second chambers such that water is prohibited from entering said third chamber when said body is submerged into the aqueous environment;

b. providing a motor assembly housed within said first chamber;

c. providing a filter section housed within said first chamber and being located downstream of said motor assembly, said first chamber having an open lateral face exposed to the aqueous environment such that the user can quickly remove said filter section during maintenance procedures;

d. positioning a rigid and rectilinear anchor shaft within said second chamber and through an entire longitudinal length of said body, said anchor shaft being removably mated to an existing swimming pool cleaning pole;

e. pivotally attaching a vacuum head directly to said anchor shaft wherein said vacuum head is disposed exterior of said body, said vacuum head including a flexible conduit in fluid communication with said filter section such that unfiltered water is directed upwardly through said conduit and into said filter section, said vacuum head further including a plurality of wheels rotatably coupled to opposed corners thereof; and f. automatically and continuously transmitting a predetermined quantity of power to said motor assembly such that a user can continuously operate said vacuum cleaner while receiving power from alternate sources;

wherein said body includes a plurality of gills formed within an outer wall thereof and situated adjacent to said motor assembly such that filtered water exits said body via said gills after the unfiltered water passes through said filter section;

wherein said automatic power transmitting means comprises first, second and third power supply sources, said first power supply source providing a 110 volt alternating current, said second and third power supply sources supplying a 12 volt direct current;

first, second and third power inlet ports respectively and directly mated to said first, second and third power supply sources;

first, second and third switches respectively and directly coupled to said first, second and third inlet ports;

a transformer electrically and directly coupled to said first switch for stepping down said 110 volt alternating current to a 12 direct current prior to reaching said motor assembly; and a voltage detecting and distribution circuit electrically mated to said first, second and third switches for detecting and continuously distributing said 12 volt direct current from at least one of said first, second and third power supply sources to said motor assembly during operating conditions such that the user can continuously operate said vacuum cleaner when any two of said first, second and third power supply sources are inactive;

wherein said first switch is normally maintained at a closed position such that said 12 volt direct current from said transformer is a primary power supply source;

wherein said second and third switches are normally maintained at open positions respective such that said 12 volt direct current from said second and third power supply sources are backup power supply sources.

12. The method of claim 11, wherein said voltage detecting and distribution circuit comprises:

a processor;

a memory electrically coupled to said processor and including software instructions that cause said voltage detecting and distribution circuit to automatically toggle said first, second and third switches between on and off positions such that only one of said first, second and third power supply sources direct a corresponding one of said 12 volt direct currents to said motor assembly, said software instructions including and executing a control logic algorithm including the steps of a. periodically inquiring about a voltage level remaining within said first, second and third power sources respectively, b. detecting whether said voltage level of said first power supply source has fallen below a predetermined minimum voltage level threshold, c. if yes, toggling said first switch to an open position;

d. determining which one of said second and third power supply sources has a lower voltage level that is above said predetermined minimum voltage level threshold;

e. toggling one of said second and third switches to a closed position that is associated with said power supply source having the lower voltage level above said predetermined minimum voltage level threshold, and f. if no, maintaining said first switch at a closed position and further maintaining said second and third switches at said open position.

13. The method of claim 11, wherein said second power supply source comprises:

a portable battery pack seated externally of said body and electrically mated with said motor assembly.

14. The method of claim 11, wherein said third power supply source comprises:

a rechargeable battery pack removably seated within said third chamber and electrically mated with said motor assembly.

15. The method of claim 11, wherein said filter section comprises:

a canister;

a cylindrical filter member housed within said canister; and a one-way check valve automatically pivotal between open and closed positions when said motor assembly is toggled to on and off positions, said filter member having axially opposed ends directly coupled to said one-way check valve and said motor assembly respectively for directing the unfiltered water through said filter and out from said body via said gills.

* * * * *